US011725437B1

(12) United States Patent
Cloud et al.

(10) Patent No.: US 11,725,437 B1
(45) Date of Patent: Aug. 15, 2023

(54) HINGE ASSEMBLY FOR A WORK VEHICLE DOOR

(71) Applicant: CNH Industrial America LLC, New Holland, PA (US)

(72) Inventors: John William Cloud, Winfield, KS (US); Daniel Owen Seacat, Sedgwick, KS (US)

(73) Assignee: CNH Industrial America LLC, New Holland, PA (US)

( * ) Notice: Subject to any disclaimer, the term of this patent is extended or adjusted under 35 U.S.C. 154(b) by 0 days.

(21) Appl. No.: 17/723,570

(22) Filed: Apr. 19, 2022

(51) Int. Cl.

| | |
|---|---|
| ***E05D 5/04*** | (2006.01) |
| ***E05D 7/12*** | (2006.01) |
| *E05D 3/02* | (2006.01) |
| *E02F 9/16* | (2006.01) |

(52) U.S. Cl.
CPC ..... *E05D 5/043* (2013.01); *E05D 7/121* (2013.01); *E02F 9/163* (2013.01); *E05D 3/02* (2013.01); *E05Y 2900/518* (2013.01); *E05Y 2900/531* (2013.01)

(58) Field of Classification Search
CPC ..... E05D 7/12; E05D 7/121; E05D 7/123; E05D 7/125; E05D 2007/126; E05D 2007/128; E05D 5/043
USPC ..... 296/190.11; 16/231, 252, 253
See application file for complete search history.

(56) References Cited

U.S. PATENT DOCUMENTS

| | | | | |
|---|---|---|---|---|
| 1,835,042 | A * | 12/1931 | Hammer | E05D 7/009 248/225.11 |
| 2,990,570 | A * | 7/1961 | Gilpatrick | E05D 7/12 16/257 |
| 3,590,419 | A * | 7/1971 | Dargene | E05D 7/12 16/235 |
| 3,965,532 | A * | 6/1976 | Wigfall | E05D 7/12 16/270 |
| 4,873,745 | A * | 10/1989 | Ramsauer | E05D 7/10 16/259 |
| 6,381,762 | B1 * | 5/2002 | Moser | A47K 13/12 4/240 |
| 7,516,518 | B2 * | 4/2009 | Kiefer | F16B 13/0858 4/607 |
| 7,614,117 | B2 * | 11/2009 | Selvaraj | E05D 7/121 16/258 |

(Continued)

FOREIGN PATENT DOCUMENTS

JP 3682436 8/2005

*Primary Examiner* — Jeffrey O'Brien
(74) *Attorney, Agent, or Firm* — Peter Zacharias

(57) ABSTRACT

A hinge assembly for a work vehicle door includes a hinge having a body and a first protrusion. The first protrusion is configured to extend through a first opening in a panel of the work vehicle door, and the first protrusion has a first engagement feature. The hinge assembly also includes a handle having a first corresponding engagement feature configured to engaged the first engagement feature of the first protrusion while the handle is in an engaged position to couple the panel to the hinge. One of the hinge or the handle has a second protrusion, and the other of the hinge or the handle has a recess configured to receive the second protrusion. The second protrusion is configured to extend through a second opening in the panel of the work vehicle door, and the handle is configured to rotate about the second protrusion to the engaged position.

20 Claims, 6 Drawing Sheets

(56) References Cited

U.S. PATENT DOCUMENTS

| | | | | |
|---|---|---|---|---|
| 7,938,479 | B2 * | 5/2011 | Tuhy | E05D 7/121 16/382 |
| 9,038,243 | B2 * | 5/2015 | Haar | E05D 7/121 16/264 |
| 9,295,347 | B2 * | 3/2016 | Mackay | A47G 1/164 |
| 9,605,459 | B2 * | 3/2017 | Veino | E06B 5/00 |
| 11,002,049 | B2 * | 5/2021 | Demski | E05D 7/121 |
| 11,541,730 | B2 * | 1/2023 | Mather | B60J 1/1823 |
| 2012/0079682 | A1 * | 4/2012 | Cheng | E05D 11/1064 16/252 |

* cited by examiner

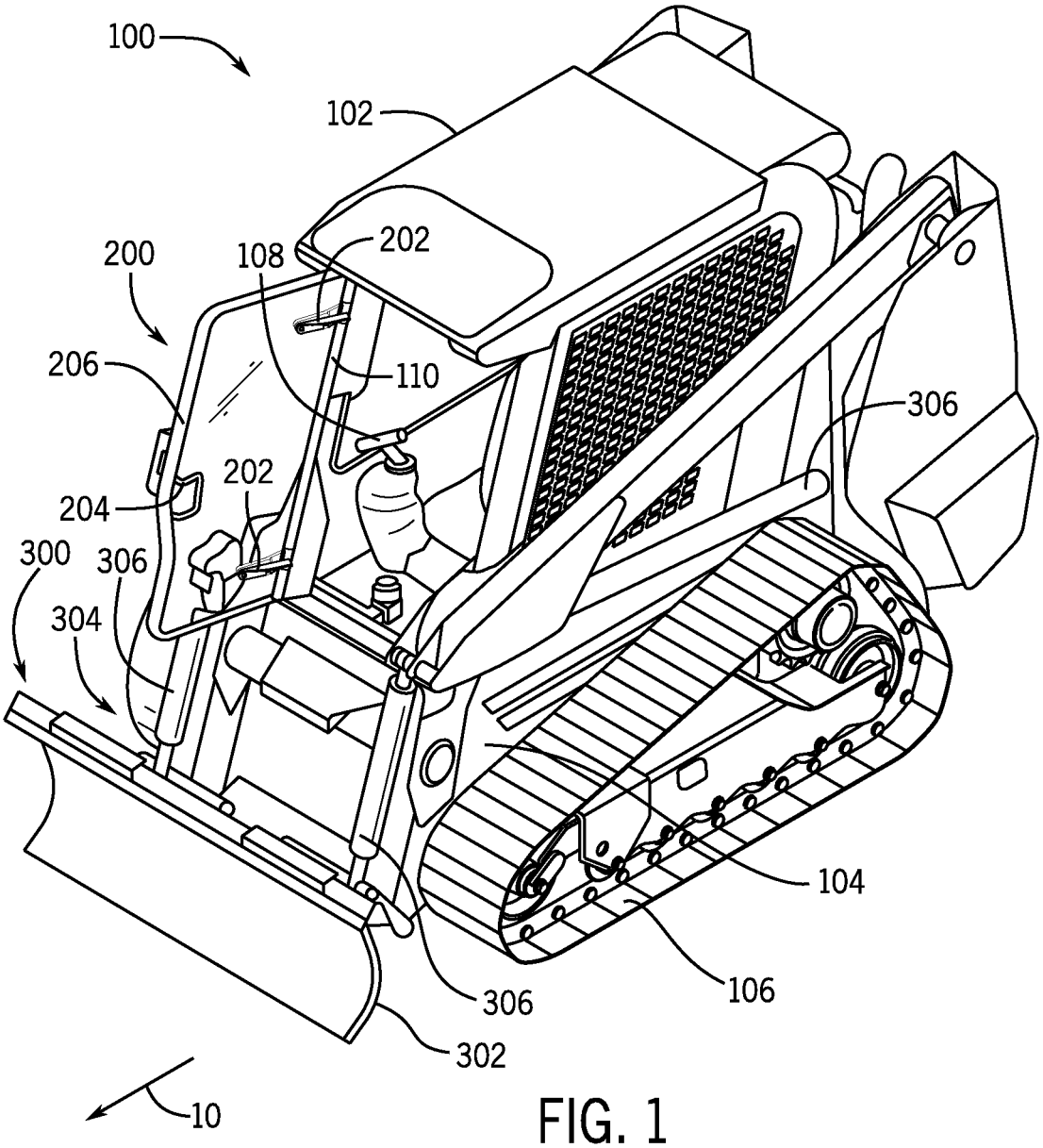
FIG. 1
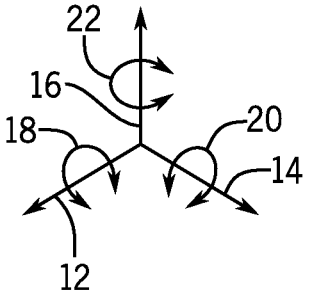

HINGE ASSEMBLY FOR A WORK VEHICLE DOOR

BACKGROUND

The present disclosure relates generally to a hinge assembly for a work vehicle door.

Certain work vehicles (e.g., tractors, harvesters, skid steers, etc.) are configured to support one or more implements (e.g., a dozer blade, a grapple, etc.). For example, a dozer blade assembly may be coupled to a chassis of the work vehicle and positioned forward of the chassis relative to a direction of travel of the work vehicle. The dozer blade assembly may include a dozer blade configured to work ground material (e.g., soil, etc.) within a work area. For example, forward movement of the work vehicle may drive the dozer blade to displace the ground material, and rearward movement of the work vehicle may drive the dozer blade to level the ground material within the work area.

Furthermore, certain work vehicles have a door configured to facilitate ingress and egress of an operator. The door may be positioned at a front of a cab configured to house the operator. Accordingly, the implement (e.g., dozer blade, etc.) positioned forward of the chassis may block rotation of the door from a closed position to an open position while the implement overlaps the door along a vertical axis of the work vehicle. For example, if operation of the work vehicle or the implement is terminated while the implement overlaps the door along the vertical axis of the work vehicle, the operator may not be able to rotate the door from the closed position to the open position to facilitate egress from the cab. Therefore, certain work vehicle doors have hinge assemblies that selectively enable a panel (e.g., glass panel) of the door to be released from hinges of the hinge assemblies, thereby enabling the panel to be removed from the cab to facilitate egress of the operator from the cab. Certain hinge assemblies are coupled to the panel via respective single openings in the panel. For example, the door may have two hinge assemblies, and each hinge assembly may be coupled to the panel via a respective single opening in the panel. Unfortunately, coupling the hinge assemblies to the panel via respective single openings may enable the panel to rotate about the hinges due to the weight of the panel, thereby enabling the panel to sag.

BRIEF DESCRIPTION

In certain embodiments, a hinge assembly for a work vehicle door includes a hinge having a body and a first protrusion. The first protrusion is configured to extend through a first opening in a panel of the work vehicle door, and the first protrusion has a first engagement feature. The hinge assembly also includes a handle having a first corresponding engagement feature configured to engaged the first engagement feature of the first protrusion while the handle is in an engaged position to couple the panel to the hinge. One of the hinge or the handle has a second protrusion, and the other of the hinge or the handle has a recess configured to receive the second protrusion. The second protrusion is configured to extend through a second opening in the panel of the work vehicle door, and the handle is configured to rotate about the second protrusion from an intermediate position to the engaged position. In addition, the second protrusion has a second engagement feature, the recess has a second corresponding engagement feature, the second engagement feature and the second corresponding engagement feature are configured to enable the handle to translate from a disengaged position to the intermediate position, and the second engagement feature and the second corresponding engagement feature are configured to engage one another while the handle is in the engaged position to couple the panel to the hinge.

DRAWINGS

These and other features, aspects, and advantages of the present disclosure will become better understood when the following detailed description is read with reference to the accompanying drawings in which like characters represent like parts throughout the drawings, wherein:

FIG. 1 is a perspective view of an embodiment of a work vehicle having a door configured to facilitate ingress and egress of an operator;

DETAILED DESCRIPTION

Figure 2:
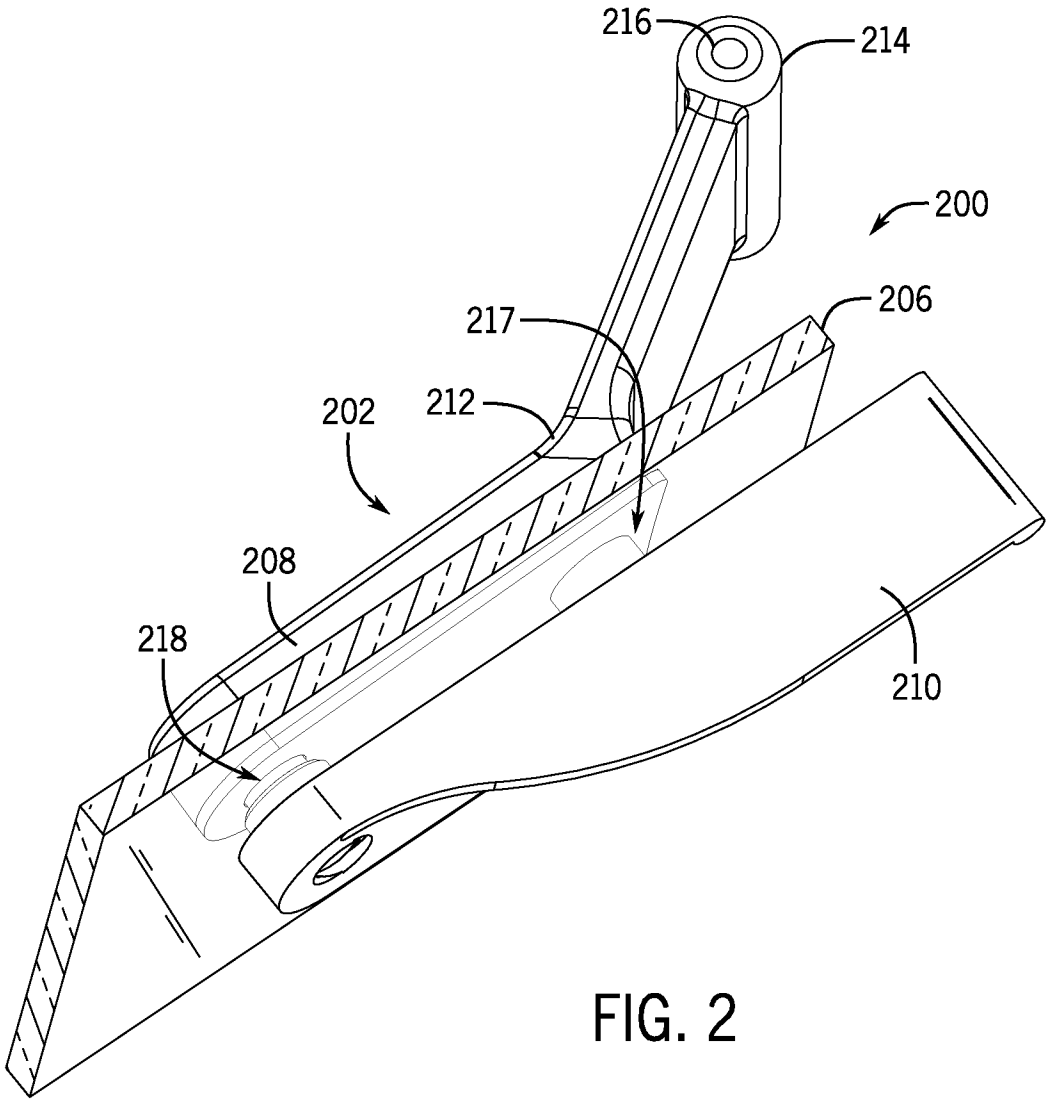
FIG. 2 is a perspective view of a portion of the door of FIG. 1, in which the door includes an embodiment of a hinge assembly.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments.

FIG. 1 is a perspective view of an embodiment of a work vehicle 100 having a door 200 configured to facilitate ingress and egress of an operator. In the illustrated embodiment, the work vehicle 100 includes a cab 102 and a chassis 104. In certain embodiments, the chassis 104 is configured to house a motor (e.g., diesel engine, electric motor, etc.), a hydraulic system (e.g., including a pump, valves, a reservoir, etc.), and other components (e.g., an electrical system, a cooling system, etc.) that facilitate operation of the work vehicle. In addition, the chassis 104 is configured to support the cab 102 and tracks 106. The tracks 106 may be driven to rotate by the motor and/or by component(s) of the hydraulic system (e.g., hydraulic motor(s), etc.). While the work vehicle 100 includes tracks 106 in the illustrated embodiment, in other embodiments, the work vehicle may include wheels or a combination of wheels and tracks.

The cab 102 is configured to house an operator of the work vehicle 100. Accordingly, various controls, such as the illustrated hand controller 108, are positioned within the cab 102 to facilitate operator control of the work vehicle 100 and implement(s) coupled to the work vehicle 100, such as the dozer blade assembly 300. For example, the controls may enable the operator to control the rotational speed of the tracks 106, thereby facilitating adjustment of the speed and the direction of the work vehicle 100. In addition, the controls may enable the operator to control the position and/or orientation of the implement(s) coupled to the work vehicle 100. In addition, the door 200 facilitates ingress and egress of the operator from the cab 102.

In the illustrated embodiment, the dozer blade assembly 300 is coupled to the chassis 104 and positioned forward of the chassis 104 relative to a forward direction of travel 10 of the work vehicle 100/dozer blade assembly 300. The work vehicle 100 includes an actuator assembly 304 configured to control a position and, in certain embodiments, an orientation of a dozer blade 302 of the dozer blade assembly 300 relative to the chassis 104. In the illustrated embodiment, the actuator assembly 304 includes hydraulic cylinders 306 configured to move the dozer blade 302 relative to the chassis 104. In addition, the actuator assembly may include a valve assembly configured to control hydraulic fluid flow to the hydraulic cylinders, thereby controlling the position and, in certain embodiments, the orientation of the dozer blade. In certain embodiments, the actuator assembly 304 may be configured to move the dozer blade 302 along a longitudinal axis 12 of the work vehicle 100, along a lateral axis 14 of the work vehicle 100, along a vertical axis 16 of the work vehicle 100, or a combination thereof. In addition, the actuator assembly 304 may be configured to rotate the dozer blade 302 about the longitudinal axis 12 in roll 18, about the lateral axis 14 in pitch 20, about the vertical axis 16 in yaw 22, or a combination thereof. While the actuator assembly includes hydraulic cylinders in the illustrated embodiment, in other embodiments, the actuator assembly may include other suitable actuator(s) (e.g., alone or in combination with the hydraulic cylinders), such as hydraulic motor(s), pneumatic actuator(s), electromechanical actuator(s), other suitable type(s) of actuator(s), or a combination thereof. Furthermore, while a dozer blade assembly 300 is coupled to the chassis 104 in the illustrated embodiment, in other embodiments, another suitable implement (e.g., a bucket, a brush mower, pallet forks, etc.) may be coupled to the chassis and positioned forward of the chassis relative to the forward direction of travel.

In the illustrated embodiment, the door 200 is coupled to a frame 110 of the cab 102 by two hinge assemblies 202. The hinge assemblies 202 enable the door 200 to rotate between the closed position that blocks access to an interior of the cab 102 and the illustrated open position that enables access to the interior of the cab 102. While the illustrated door 200 includes two hinge assemblies 202 in the illustrated embodiment, in other embodiments, the door may include more or fewer hinge assemblies (e.g., 1, 3, 4, or more).

Furthermore, in the illustrated embodiment, the door 200 includes a handle assembly 204 configured to enable the operator to rotate the door between the open and closed positions. The handle assembly 204 is also configured to selectively block rotation of the door 200 while the door is in the closed position via a connection between the handle assembly 204 and the frame 110 of the cab 102. For example, a protrusion of the handle assembly may engage a recess in the frame of the cab to block rotation of the door. The operator may actuate the handle assembly 204 (e.g., rotate a handle of the handle assembly) to disengage the connection between the handle assembly and the frame of the cab (e.g., disengage the protrusion of the handle assembly from the recess of the cab frame), thereby facilitating rotation of the door from the closed position to the open position. In certain embodiments, the handle assembly may enable the operator to lock the door while the door is in the closed position.

Because the door 200 is positioned at the front of the cab 102, the dozer blade 302 or other implement coupled to the chassis 104 and positioned forward of the chassis 104 may block rotation of the door 200 from the closed position to the open position while the dozer blade 302/other implement overlaps the door 202 along the vertical axis 16 of the work vehicle 100. For example, if operation of the work vehicle or the dozer blade assembly/other implement assembly is terminated while the dozer blade/other implement overlaps the door along the vertical axis of the work vehicle, the operator may not be able to rotate the door from the closed position to the open position to facilitate egress from the cab. Accordingly, in the illustrated embodiment, the hinge assemblies 202 facilitate selective disengagement of a panel 206 of the door 200 from hinges of the hinge assemblies 202. For example, if rotation of the door 200 is blocked by the dozer blade 302/other implement, the operator may actuate the handle assembly 204 to disengage the connection between the handle assembly and the frame of the cab, and the operator may actuate handles of the hinge assemblies 202 to disengage the panel 206 from the hinges. The operator may then remove the panel 206 (e.g., move the panel 206 to the interior of the cab 102, rotate the panel 206 about the lateral axis 14 and move the panel forwardly under the dozer blade 302/other implement, etc.) to facilitate egress from the cab 102 of the work vehicle 100. In certain embodiments, the panel is entirely transparent (e.g., the entire panel is formed from transparent material, such as glass and/or plastic) to enhance forward operator visibility. However, in other embodiments, at least a portion of the panel may be opaque or translucent.

In certain embodiments, at least one hinge assembly 202 (e.g., each hinge assembly 202, etc.) includes a hinge having a body and a first protrusion. The first protrusion is configured to extend through a first opening in the panel 206, and the first protrusion has a first engagement feature. In addition, the hinge assembly 202 includes a handle having a first corresponding engagement feature configured to engage the first engagement feature of the first protrusion while the handle is in an engaged position to couple the panel 206 to the hinge. One of the hinge or the handle has a second protrusion, and the other of the hinge or the handle has a recess configured to receive the second protrusion. The second protrusion is configured to extend through a second opening in the panel 206, and the handle is configured to rotate about the second protrusion from an intermediate position to the engaged position. Furthermore, the second protrusion has a second engagement feature, and the recess has a second corresponding engagement feature. The second engagement feature and the second corresponding engagement feature are configured to enable the handle to translate from a disengaged position to the intermediate position, and the second engagement feature and the second corresponding engagement feature are configured to engage one another while the handle is in the engaged position to couple the panel to the hinge.

Because the hinge assembly includes two protrusions extending through two respective openings in the panel, rotation of the panel relative to the hinge assembly may be substantially blocked, thereby substantially reducing sagging of the panel (e.g., as compared to a hinge assembly having a single protrusion extending through a single opening in the panel). Furthermore, because the hinge is coupled to the panel with a single handle, the operator may remove the panel from the hinge quickly, thereby reducing egress time (e.g., as compared to a hinge assembly having multiple protrusions and a separate fastener for each protrusion). In addition, because the hinge is coupled to the panel with a single handle, the number of components of the hinge assembly may be reduced (e.g., as compared to a hinge assembly having multiple protrusions and a separate fastener for each protrusion). Furthermore, in certain embodiments, the hinge assembly has two protrusions. In such embodiments, the protrusions and the corresponding panel openings may be spaced apart from one another to reduce stress on the panel (e.g., as compared to a hinge assembly having three or more protrusions, in which the protrusions and the corresponding panel openings are tightly spaced).

While the hinge assembly 202 is disclosed herein with regard to a door positioned at the front of a cab 102, in certain embodiments, the hinge assembly disclosed herein may be employed within another suitable door, such as a door positioned at a left/right side of a cab or a door positioned at a rear of a cab. Furthermore, the hinge assembly disclosed herein may be employed within a door of any suitable type of work vehicle, such as a skid steer, a tractor, a sprayer, or a dozer. The hinge assembly disclosed herein may also be employed within a door of another suitable structure (e.g., building, room, compartment, etc.). In addition, while the hinge assembly 202 is disclosed herein with regard to a door having a transparent panel, in certain embodiments, the hinge assembly disclosed herein may be employed within a door having a translucent panel or an opaque panel.

FIG. 2 is a perspective view of a portion of the door 200 of FIG. 1, in which the door 200 includes an embodiment of the hinge assembly 202. In the illustrated embodiment, the hinge assembly 202 includes a hinge 208 and a handle 210. The hinge 208 is configured to couple to the frame of the cab and to facilitate rotation of the door 200 relative to the cab frame. In addition, the hinge 208 is configured to support the door 200 on the cab frame. As illustrated, the hinge 208 has a body 212, and a mount 214 is coupled to the body 212. The mount 214 is configured to rotatably couple the hinge 208 to the cab frame. In the illustrated embodiment, the mount 214 includes a passage 216 configured to receive an axle, and the door 200 is configured to rotate about the axle.

However, in other embodiments, the mount may include one or more cylindrical protrusions configured to engage one or more corresponding recesses within the cab frame to facilitate rotation of the door relative to the cab frame. Furthermore, in certain embodiments, one or more bushings and/or bearings may be employed at/proximate to the mount 214 to facilitate rotation of the door relative to the cab frame.

As discussed in detail below, the hinge 208 also includes a first protrusion and a second protrusion. The first protrusion is configured to extend through a first opening 217 in the panel 206, and the second protrusion is configured to extend through a second opening 218 in the panel 206. In addition, the first protrusion has a first engagement feature, and the second protrusion has a second engagement feature. Furthermore, as discussed in detail below, a gasket may be disposed between the hinge 208 and the panel 206 to block direct contact between the body 212 of the hinge 208 and the panel 206. In addition, a bushing may be disposed about the first protrusion (e.g., between the first protrusion and the panel) to distribute a contact force on the panel over a larger area.

Furthermore, the handle 210 includes a recess and a first corresponding engagement feature. The recess is configured to receive the second protrusion, and the handle 210 is configured to rotate about the second protrusion from an intermediate position to the illustrated engaged position. In addition, the recess has a second corresponding engagement feature, and the second engagement feature and the second corresponding engagement feature are configured to enable the handle to translate from a disengaged position to the intermediate position. As discussed in detail below, the first corresponding engagement feature is configured to engage the first engagement feature of the first protrusion while the handle is in the illustrated engaged position to couple the panel 206 to the hinge 208, and the second engagement feature and the second corresponding engagement feature are configured to engage one another while the handle is in the illustrated engaged position to couple the panel 206 to the hinge 208. Because the hinge assembly includes two protrusions extending through two respective openings in the panel, rotation of the panel relative to the hinge assembly may be substantially blocked, thereby substantially reducing sagging of the panel (e.g., as compared to a hinge assembly having a single protrusion extending through a single opening in the panel).

In certain embodiments, the hinge 208 may be formed from ductile iron. For example, the hinge 208 may be formed from ductile iron via a casting process. Furthermore, in certain embodiments, the hinge may be formed from other suitable material(s) (e.g., alone or in combination with ductile iron), such as steel, aluminum, a composite material, a polymeric material, other suitable material(s), or a combination thereof. In certain embodiments, the mount 214 may be coupled to the body 212 by an integral connection. For example, the mount 214 and the body 212 may be integrally formed from a single piece of material (e.g., ductile iron, etc.) via any suitable process(es), such as casting, additive manufacturing, machining, other suitable process(es), or a combination thereof. Furthermore, in certain embodiments, the first protrusion and/or the second protrusion may be coupled to the body 212 by an integral connection. For example, the first protrusion and/or the second protrusion may be integrally formed with the body 212 of the hinge 208 from a single piece of material (e.g., ductile iron, etc.) via any suitable process(es), such as casting, additive manufacturing, machining, other suitable process(es), or a combination thereof. In addition, in certain embodiments, the mount, the first protrusion, the second protrusion, or a combination thereof, may be formed separately from the body and coupled to the body via any suitable type(s) of connection(s), such as adhesive connection(s), welded connection(s), fastener connection(s), other suitable type(s) of connection(s), or a combination thereof.

Furthermore, in certain embodiments, the handle 210 may be formed from a polymeric material, such as nylon. For example, the handle 210 may be formed from polymeric material via an injection molding process. At least in embodiments in which the handle 210 is formed from polymeric material, the handle 210 may directly contact the panel 206 (e.g., transparent panel, etc.). Furthermore, in certain embodiments, the handle may be formed from other suitable material(s) (e.g., alone or in combination with the polymeric material), such as metal and/or a composite material. While no gasket is disposed between the handle and the panel in the illustrated embodiment, in certain embodiments (e.g., in embodiments in which the handle is formed from metal), a gasket may be disposed between the handle and the panel.

Figure 3:
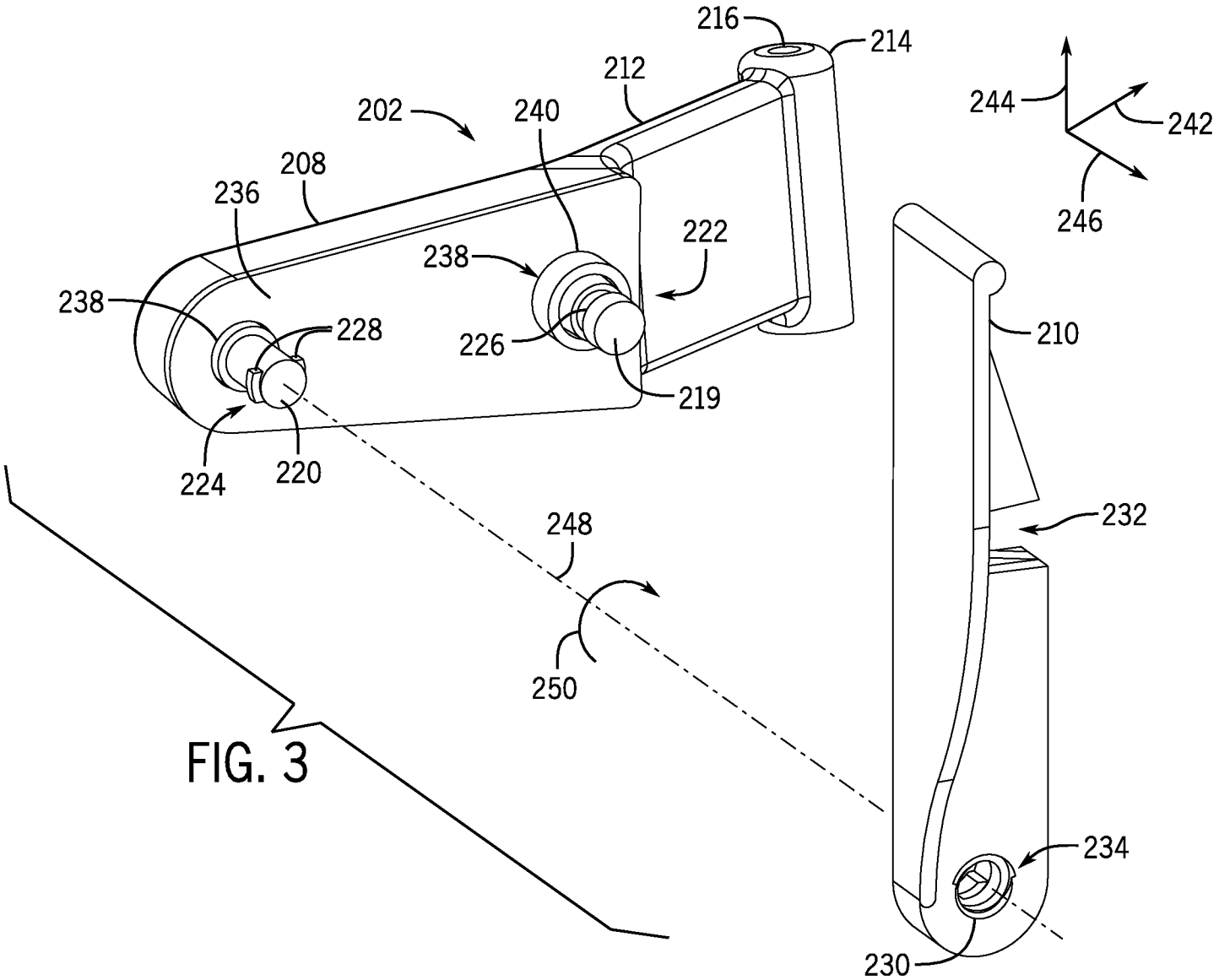
FIG. 3 is a perspective view of the hinge assembly of FIG. 2, in which a handle of the hinge assembly is in a disengaged position.

FIG. 3 is a perspective view of the hinge assembly 202 of FIG. 2, in which the handle 210 of the hinge assembly 202 is in the disengaged position. As previously discussed, the hinge 208 has a first protrusion 219 and a second protrusion 220, and each protrusion is configured to extend through a respective opening in the panel. In addition, the first protrusion 219 is coupled to the body 212 of the hinge 208, and the second protrusion 220 is coupled to the body 212 of the hinge 208. For example, as previously discussed, the first protrusion 219 and/or the second protrusion 220 may be coupled to the body 212 by an integral connection (e.g., integrally formed with the body). As illustrated, the first protrusion 219 has a first engagement feature 222, and the second protrusion 220 has a second engagement feature 224. In the illustrated embodiment, the first engagement feature 222 includes a groove 226 within the first protrusion 219, and the second engagement feature 224 includes one or more ridges 228.

Furthermore, in the illustrated embodiment, the handle 210 has a recess 230 (e.g., aperture, opening, etc.) and a first corresponding engagement feature 232. The recess 230 is configured to receive the second protrusion 220, and the handle 210 is configured to rotate about the second protrusion 220 from an intermediate position to an engaged position. In addition, the recess 230 has a second corresponding engagement feature 234. In the illustrated embodiment, the second corresponding engagement feature 234 includes one or more ridges configured to engage respective ridge(s) of the second engagement feature 224. Furthermore, the second engagement feature 224 and the second corresponding engagement feature 234 are configured to enable the handle 210 to move (e.g., translate) from the illustrated disengaged position to the intermediate position, in which the second protrusion 220 is disposed within the recess 230. The first corresponding engagement feature 232 is configured to engage the first engagement feature 222 of the first protrusion 219 while the handle 210 is in the engaged position to couple the handle 210 and the panel to the hinge 208, and the second engagement feature 224 and the second corresponding engagement feature 234 are configured to engage one another while the handle 210 is in the engaged position to couple the handle 210 and the panel to the hinge 208.

In the illustrated embodiment, the hinge assembly 202 includes a gasket 236 configured to be disposed between the hinge 208 and the panel. The gasket 236 is configured to block direct contact between the hinge 208 and the panel, thereby substantially reducing wear on the panel. As illustrated, the gasket 236 has apertures 238, and the first and second protrusions extend through the apertures, thereby enabling the gasket 236 to engage the body 212 of the hinge 208. The gasket 236 may be formed from any suitable material(s) (e.g., including polymeric materials, natural rubber, fibers, other suitable type(s) of material(s), or a combination thereof). In the illustrated embodiment, the gasket 236 covers a substantial portion of the panel-facing surface of the hinge body 212. However, in other embodiments, the gasket may cover a smaller portion of the panel-facing surface. Furthermore, while the hinge assembly 202 includes a single gasket 236 in the illustrated embodiment, in other embodiments, the hinge assembly may include more or fewer gaskets (e.g., 0, 2, 3, 4, 5, 6, or more). For example, in embodiments including multiple gaskets, gaskets may cover different portions of the panel-facing surface of the hinge body, and/or gaskets may be stacked between the hinge body and the panel.

Furthermore, in the illustrated embodiment, the hinge assembly 202 includes a bushing 240 disposed about the first protrusion 219. Accordingly, the bushing 240 is configured to be disposed between the first protrusion 219 and the panel. The bushing 240 is configured to distribute a contact force on the panel over a larger area (e.g., as compared to the protrusion alone). The bushing 240 may be formed from any suitable material(s) (e.g., including polymeric materials, natural rubber, fibers, other suitable type(s) of material(s), or a combination thereof). While the hinge assembly 202 includes a single bushing 240 disposed about the first protrusion 219 in the illustrated embodiment, in other embodiments, the hinge assembly may include more or fewer bushings (e.g., 0, 2, 3, 4, 5, 6, or more) disposed about the first protrusion. In addition, while no bushing is disposed about the second protrusion 220 in the illustrated embodiment, in other embodiments, one or more bushings may be disposed about the second protrusion to distribute a contact force on the panel over a larger area.

To couple the panel to the hinge 208, the gasket 236 may be disposed on the panel-facing surface of the body 212 of the hinge 208, such that the first protrusion 219 and the second protrusion 220 extend through respective apertures 238 of the gasket 236. The bushing 240 may then be disposed about the first protrusion 219. Next, the first opening in the panel may be aligned with the first protrusion 219 along a lateral axis 242 and a vertical axis 244 of the hinge assembly 202, and the second opening in the panel may be aligned with the second protrusion 220 along the lateral axis 242 and the vertical axis 244. The hinge 208 may be moved toward the panel along a lateral axis 246 of the hinge assembly 202, and/or the panel may be moved toward the hinge 208 along the lateral axis 246, such that the panel engages the gasket 236 and the protrusions of the hinge 208 extend through the respective openings in the panel. Next, the recess 230 of the handle 210 may be aligned with the second protrusion 220 along the lateral axis 242 and the vertical axis 244. The handle 210 may then be moved (e.g., translated) toward the hinge 208 from the illustrated disengaged position to the intermediate position, in which the second protrusion 220 is disposed within the recess 230 of the handle 210. The handle 210 may then be rotated about a rotation axis 248 in a first direction 250 from the intermediate position to the engaged position. As the handle 210 rotates in the first direction 250, the second engagement feature 224 and the second corresponding engagement feature 234 engage one another. For example, the ridge(s) 228 of the second engagement feature 224 may engage corresponding ridge(s) of the second corresponding engagement feature 234. In addition, as the handle 210 reaches the engaged position, the first corresponding engagement feature 232 engages the first engagement feature 222. For example, a tongue of the first corresponding engagement feature 232 may engage the groove 226 of the first engagement feature 222. Engagement of the respective engagement features block movement of the handle 210 away from the hinge 208 along the longitudinal axis 246, thereby coupling the panel to the hinge 208. The process disclosed above may be repeated for each hinge of the work vehicle door, and once each hinge is coupled to the panel, the hinges may be rotatably coupled to the cab frame of the work vehicle.

As previously discussed, the second engagement feature 224 includes ridge(s) 228, and the second corresponding engagement feature 234 includes corresponding ridge(s). The ridge(s) 228 of the second engagement feature 224 and the ridge(s) of the second corresponding engagement feature 234 are configured to engage one another while the handle 210 is in the engaged position to couple the panel to the hinge 208. In addition, the ridges of the second engagement feature and the second corresponding engagement feature are configured to enable the handle 210 to move (e.g., translate) from the illustrated disengaged position to the intermediate position. In the illustrated embodiment, the ridges are configured to enable the handle 210 to move (e.g., translate) from the disengaged position to the intermediate position while the handle is oriented substantially along the vertical axis 244. However, in other embodiments, the ridges may be configured to enable the handle to move from the disengaged position to the intermediate position while the handle is oriented at another suitable angle relative to the hinge. Furthermore, in the illustrated embodiment, the ridges of the second engagement feature 224 and the second corresponding engagement feature 234 extend along a spiral path about the rotation axis 248 (e.g., at least while the handle 210 is in the engaged position, the intermediate position, or the disengaged position). Accordingly, as the handle 210 rotates in the first direction 250 from the intermediate position to the engaged position, the ridges drive the handle 210 to move toward the hinge 208 along the longitudinal axis 246. As a result, while the handle 210 is in the engaged position, the handle 210 and the hinge 208 apply a compressive force to the panel and the gasket 236 along the longitudinal axis 246, thereby compressing the gasket 236.

While the ridges of the second engagement feature 224 and the second corresponding engagement feature 234 extend along a spiral path in the illustrated embodiment, in other embodiments, the ridges may be flat along the longitudinal axis. In such embodiments, an operator may move the handle toward the hinge to apply the compressive force to the panel and the gasket and to position the second corresponding engagement feature in a longitudinal position to engage the second engagement feature. The operator may then rotate the handle about the rotation axis in the first direction to the engaged position. Furthermore, while the second engagement feature 224 includes two ridges 228 in the illustrated embodiment, in other embodiments, the second engagement feature may include more or fewer ridges (e.g., 1, 3, 4, or more), and the second corresponding engagement feature may have a corresponding/complementary number of corresponding ridge(s). In addition, while the second engagement feature 224 and the second corresponding engagement feature 234 include ridges in the illustrated embodiment, in other embodiments, the second engagement feature and the second corresponding engagement feature may include other suitable structures configured to enable the handle to translate from the disengaged position to the intermediate position and to engage one another while the handle is in the engaged position. For example, one engagement feature may include one or more pins, and the other engagement feature may include one or more corresponding recesses configured to receive the pin(s).

As previously discussed, the first engagement feature 222 includes a groove 226, and the first corresponding engagement feature 232 includes a tongue configured to engage the groove 226. Accordingly, while the handle 210 is in the engaged position, the tongue engages the groove 226, thereby coupling the panel to the hinge 208. While the first engagement feature 222 includes a groove 226 in the illustrated embodiment, in other embodiments, the first engagement feature may include another suitable element configured to engage the tongue, such as one or more ridges or one or more pins. Furthermore, while the first engagement feature 222 includes a groove 226 and the first corresponding engagement feature 232 includes a tongue in the illustrated embodiment, in other embodiments, the first engagement feature and the first corresponding engagement feature may include other suitable elements configured to engage one another while the handle is in the engaged position to couple the panel to the hinge. For example, in certain embodiments, the first engagement feature may include a tongue, and the first corresponding engagement feature may include a groove. Furthermore, in certain embodiments, the first engagement feature may include one or more pins, and the first corresponding engagement feature may include one or more corresponding recesses configured to receive the pins.

Furthermore, in the illustrated embodiment, the hinge 208 has the second protrusion 220, and the handle 210 has the recess 230. However, in other embodiments, the handle may have the second protrusion, and the hinge may have the recess. In such embodiments, the second protrusion of the handle may engage the recess of the hinge as the handle moves (e.g., translates) along the longitudinal axis from the disengaged position to the intermediate position, and the handle may rotate about the second protrusion from the intermediate position to the engaged position. In addition, while the first protrusion 219 is positioned closer to the mount 214 than the second protrusion 220/recess in the illustrated embodiment, in other embodiments, the second protrusion/recess may be positioned closer to the mount than the first protrusion. In such embodiments, the handle may be configured to rotate in a second direction, opposite the first direction, about the rotation axis from the intermediate position to the engaged position. Furthermore, in the illustrated embodiment, the hinge assembly 202 has two protrusions. The protrusions and the corresponding panel openings may be spaced apart from one another (e.g., along the lateral axis) to reduce stress on the panel (e.g., as compared to a hinge assembly having three or more protrusions, in which the protrusions and the corresponding panel openings are tightly spaced). While the hinge assembly has two protrusions in the illustrated embodiment, in other embodiments, the hinge assembly may have more protrusions (e.g., 3, 4, 5, 6, or more).

Figure 4:
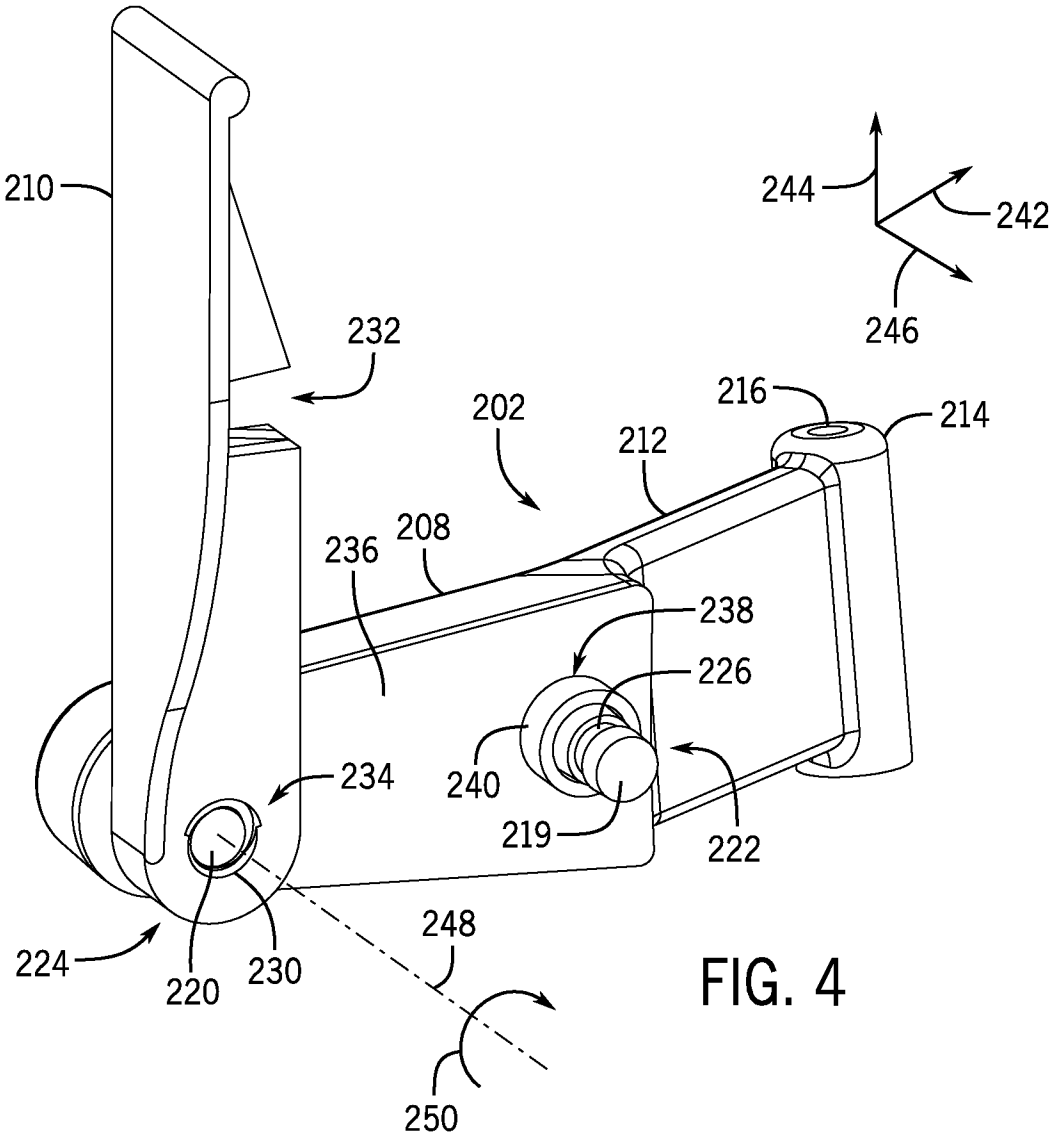
FIG. 4 is a perspective view of the hinge assembly of FIG. 2, in which the handle is in an intermediate position.

FIG. 4 is a perspective view of the hinge assembly 202 of FIG. 2, in which the handle 210 is in the intermediate position. As previously discussed, the handle 210 may be moved from the disengaged position to the intermediate position via translation of the handle 210 toward the hinge 208 along the longitudinal axis 246. Once the handle 210 is in the intermediate position, the handle 210 may be rotated about the rotation axis 248 in the first direction 250 from the illustrated intermediate position to the engaged position. While the handle 210 is in the engaged position, the first corresponding engagement feature 232 engages the first engagement feature 222, and the second engagement feature 224 and the second corresponding engagement feature 234 engage one another, thereby coupling the panel to the hinge 208. In the illustrated embodiment, the handle 210 is configured to rotate about 90 degrees from the intermediate position to the engaged position. However, in other embodiments, the handle may rotate more or less than 90 degrees from the intermediate position to the engaged position (e.g., 20 degrees, 40 degrees, 60 degrees, 80 degrees, 100 degrees, 120 degrees, 140 degrees, 180 degrees, 200 degrees, 220 degrees, 240 degrees, or more).

Figure 5:
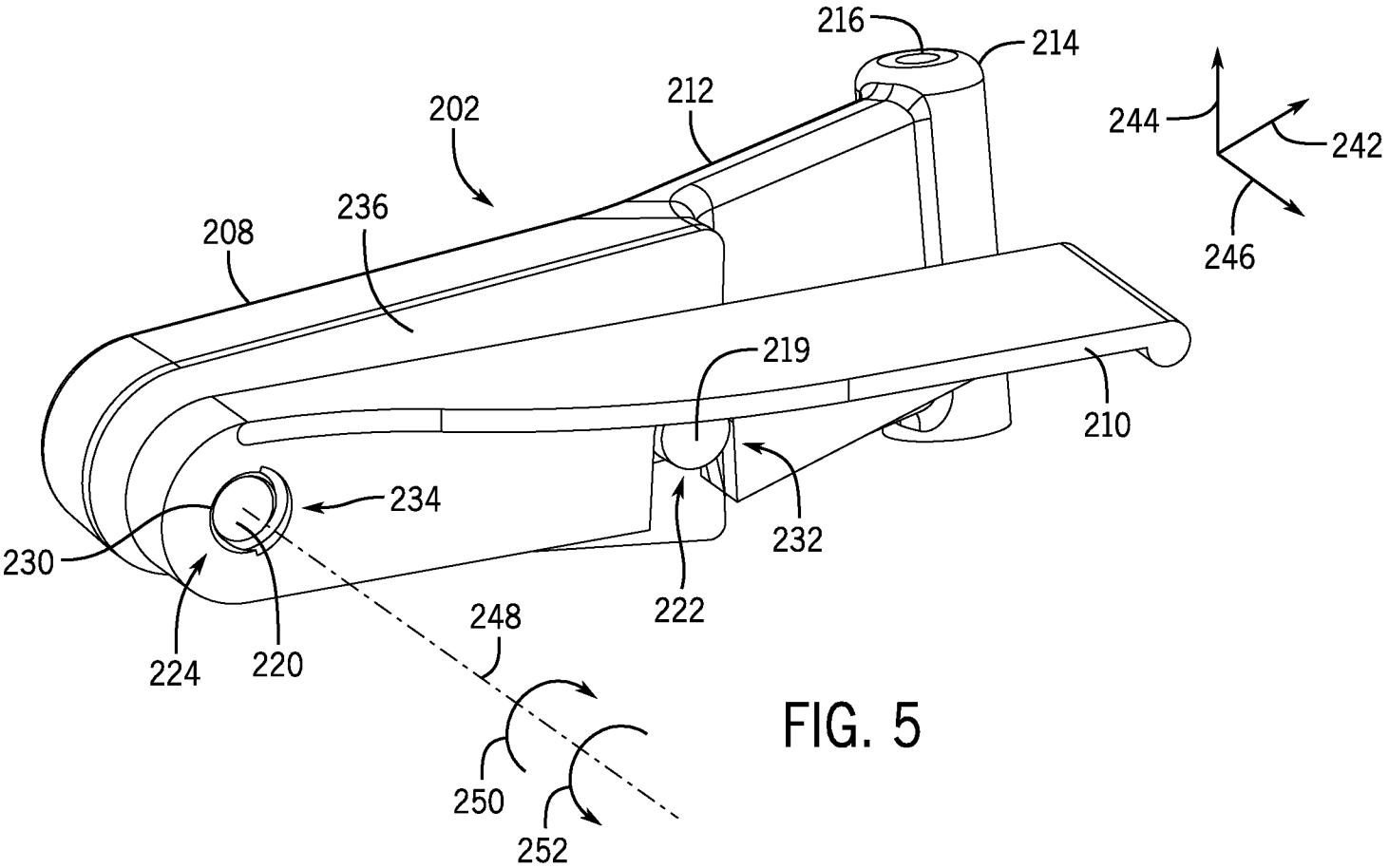
FIG. 5 is a perspective view of the hinge assembly of FIG. 2, in which the handle is in an engaged position.

FIG. 5 is a perspective view of the hinge assembly 202 of FIG. 2, in which the handle 210 is in the engaged position. As previously discussed, with the handle 210 in the illustrated engaged position, the first engagement feature 222 of the first protrusion 219 is engaged with the first corresponding engagement feature 232 of the handle 210, and the second engagement feature 224 of the second protrusion 220 is engaged with the second corresponding engagement feature 234 of the handle 210, thereby coupling the handle 210 and the panel, which is disposed between the handle 210 and the hinge 208, to the hinge 208. If rotation of the door is blocked by the dozer blade/other implement, the operator may actuate the handle assembly of the door to disengage the connection between the handle assembly and the frame of the cab, and the operator may actuate the handle 210 of each hinge assembly 202 to disengage the panel from the hinges. In the illustrated embodiment, actuation of the handle 210 includes rotating the handle 210 about the rotation axis 248 in a second direction 252 from the illustrated engaged position to the intermediate position and moving (e.g., translating) the handle 210 along the longitudinal axis 246 from the intermediate position to the disengaged position, thereby removing the handle 210 from the hinge 208. Because the second engagement feature 224 and the second corresponding engagement feature 234 are configured to enable the handle to translate from the intermediate position to the disengaged position, the handle 210 may be removed from the hinge 208 once the handle rotates to the intermediate position. Once the handles are removed from the hinges, the operator may remove the panel (e.g., move the panel to the interior of the cab, rotate the panel about a lateral axis and move the panel forwardly under the dozer blade/other implement, etc.) to facilitate egress from the cab of the work vehicle.

Figure 6:
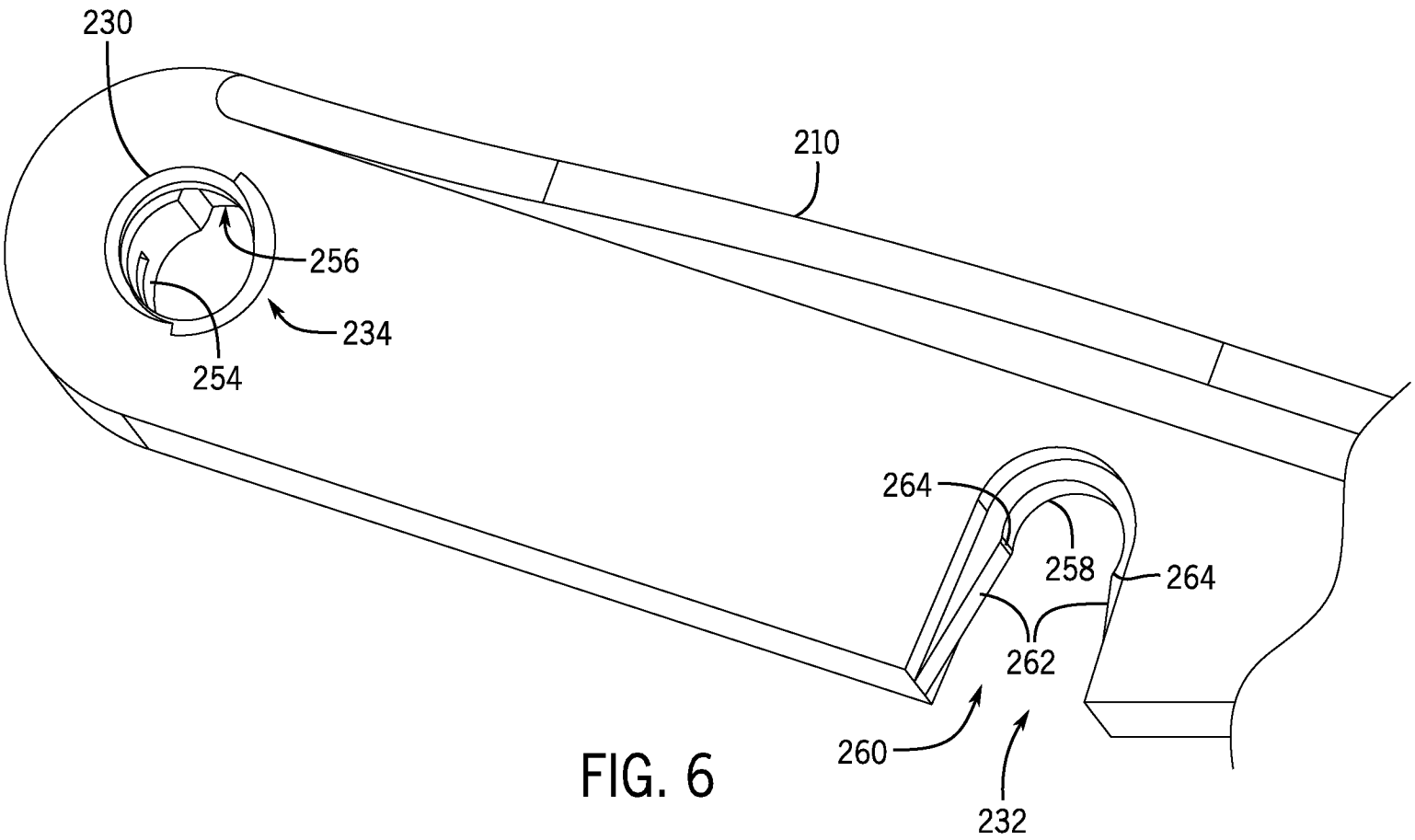
FIG. 6 is a perspective view of a portion of the handle of the hinge assembly of FIG. 2.

FIG. 6 is a perspective view of a portion of the handle 210 of the hinge assembly of FIG. 2. As previously discussed, the second engagement feature includes ridge(s), and the second corresponding engagement feature 234 includes corresponding ridge(s) 254. The ridge(s) of the second engagement feature and the ridge(s) 254 of the second corresponding engagement feature 234 are configured to engage one another while the handle 210 is in the engaged position to couple the panel to the hinge. In addition, the ridges of the second engagement feature and the second corresponding engagement feature are configured to enable the handle 210 to move (e.g., translate) from the disengaged position to the intermediate position and from the intermediate position to the disengaged position. In the illustrated embodiment, the ridge(s) 254 form gap(s) 256 configured to receive respective ridge(s) of the second engagement feature of the hinge as the handle 210 moves from the disengaged position to the intermediate position, thereby enabling the handle 210 to move from the disengaged position to the intermediate position. The gap(s) 256 also enable the handle 210 to move (e.g., translate) from the intermediate position to the disengaged position. Furthermore, in the illustrated embodiment, the ridges of the second engagement feature and the second corresponding engagement feature 234 extend along a spiral path. Accordingly, as the handle 210 rotates in the first direction from the intermediate position to the engaged position, the ridges drive the handle 210 to move toward the hinge. As a result, while the handle 210 is in the engaged position, the handle 210 and the hinge apply a compressive force to the panel and the gasket, thereby compressing the gasket.

Furthermore, as previously discussed, the first engagement feature of the first protrusion of the hinge includes a groove, and the first corresponding engagement feature 232 of the handle 210 includes a tongue 258 configured to engage the groove. Accordingly, while the handle 210 is in the engaged position, the tongue 258 engages the groove, thereby coupling the handle 210 and the panel to the hinge. In the illustrated embodiment, the handle 210 has a notch 260 configured to receive the first protrusion as the handle 210 rotates from the intermediate position to the engaged position, and the tongue 258 is formed along the notch 260. Accordingly, the tongue 258 engages the groove of the first engagement feature while the handle 210 is in the engaged position. In the illustrated embodiment, ramps 262 are formed on the notch 260 and configured to engage the groove of the first engagement feature as the handle approaches the engaged position during the rotation from the intermediate position to the engaged position. The ramps 262 are configured to guide the groove to the tongue 258 as the handle reaches the engaged position. Furthermore, in the illustrated embodiment, peaks 264 are formed on the notch between respective ramps 262 and the tongue 258. The peaks 264 are configured to establish a detent that blocks rotation of the handle from the engaged position to the intermediate position while the handle is in the engaged position, thereby substantially reducing or eliminating the possibility of unintentional rotation of the handle 210 away from the engaged position. To rotate the handle from the engaged position to the intermediate position, the operator may apply a sufficient torque to the handle 210 to overcome the resistance provided by the peaks 264. While the ramps 262 and the peaks 264 are formed on the notch 260 in the illustrated embodiment, in other embodiments, at least one ramp and/or at least one peak may be omitted.

While only certain features have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical.

The invention claimed is:

1. A hinge assembly for a work vehicle door, comprising:

a hinge having a body and a first protrusion, wherein the first protrusion is configured to extend through a first opening in a panel of the work vehicle door, and the first protrusion has a first engagement feature; and a handle having a first corresponding engagement feature configured to engage the first engagement feature of the first protrusion while the handle is in an engaged position to couple the panel to the hinge;

wherein one of the hinge or the handle has a second protrusion, the other of the hinge or the handle has a recess configured to receive the second protrusion, the second protrusion is configured to extend through a second opening in the panel of the work vehicle door, the handle is configured to rotate about the second protrusion from an intermediate position to the engaged position, the second protrusion has a second engagement feature, the recess has a second corresponding engagement feature, the second engagement feature and the second corresponding engagement feature are configured to enable the handle to translate from a disengaged position to the intermediate position, and the second engagement feature and the second corresponding engagement feature are configured to engage one another while the handle is in the engaged position to couple the panel to the hinge.

2. The hinge assembly of claim 1, wherein the first engagement feature comprises a groove within the first protrusion, and the first corresponding engagement feature comprises a tongue configured to engage the groove.

3. The hinge assembly of claim 1, wherein the second engagement feature comprises a ridge, and the second corresponding engagement feature comprises a corresponding ridge.

4. The hinge assembly of claim 1, wherein the handle is configured to rotate 90 degrees from the intermediate position to the engaged position.

5. The hinge assembly of claim 1, comprising a gasket configured to be disposed between the hinge and the panel.

6. The hinge assembly of claim 1, comprising a bushing disposed about the first protrusion.

7. The hinge assembly of claim 1, wherein the hinge is formed from ductile iron.

8. The hinge assembly of claim 1, wherein the handle is formed from nylon.

9. A hinge assembly for a work vehicle door, comprising:

a hinge having a body, a first protrusion, and a second protrusion, wherein the first protrusion is configured to extend through a first opening in a panel of the work vehicle door, the first protrusion has a first engagement feature, the second protrusion is configured to extend through a second opening in the panel, and the second protrusion has a second engagement feature; and a handle having a recess and a first corresponding engagement feature, wherein the recess is configured to receive the second protrusion, the handle is configured to rotate about the second protrusion from an intermediate position to an engaged position, the recess has a second corresponding engagement feature, the second engagement feature and the second corresponding engagement feature are configured to enable the handle to translate from a disengaged position to the intermediate position, the first corresponding engagement feature is configured to engage the first engagement feature of the first protrusion while the handle is in the engaged position to couple the panel to the hinge, and the second engagement feature and the second corresponding engagement feature are configured to engage one another while the handle is in the engaged position to couple the panel to the hinge.

10. The hinge assembly of claim 9, wherein the first engagement feature comprises a groove within the first protrusion, and the first corresponding engagement feature comprises a tongue configured to engage the groove.

11. The hinge assembly of claim 9, wherein the second engagement feature comprises a ridge, and the second corresponding engagement feature comprises a corresponding ridge.

12. The hinge assembly of claim 9, wherein the handle is configured to rotate 90 degrees from the intermediate position to the engaged position.

13. The hinge assembly of claim 9, comprising a gasket configured to be disposed between the hinge and the panel, a bushing disposed about the first protrusion, or a combination thereof.

14. The hinge assembly of claim 9, wherein the hinge is formed from ductile iron.

15. The hinge assembly of claim 9, wherein the handle is formed from nylon.

16. A work vehicle door, comprising:

a panel having a first opening and a second opening; and a hinge assembly comprising:

a hinge having a body and a first protrusion, wherein the first protrusion is configured to extend through the first opening in the panel, and the first protrusion has a first engagement feature; and a handle having a first corresponding engagement feature configured to engage the first engagement feature of the first protrusion while the handle is in an engaged position to couple the panel to the hinge;

wherein one of the hinge or the handle has a second protrusion, the other of the hinge or the handle has a recess configured to receive the second protrusion, the second protrusion is configured to extend through the second opening in the panel, the handle is configured to rotate about the second protrusion from an intermediate position to the engaged position, the second protrusion has a second engagement feature, the recess has a second corresponding engagement feature, the second engagement feature and the second corresponding engagement feature are configured to enable the handle to translate from a disengaged position to the intermediate position, and the second engagement feature and the second corresponding engagement feature are configured to engage one another while the handle is in the engaged position to couple the panel to the hinge.

17. The work vehicle door of claim 16, wherein the first engagement feature comprises a groove within the first protrusion, and the first corresponding engagement feature comprises a tongue configured to engage the groove.

18. The work vehicle door of claim 16, wherein the second engagement feature comprises a ridge, and the second corresponding engagement feature comprises a corresponding ridge.

19. The work vehicle door of claim 16, wherein the hinge assembly comprises a gasket disposed between the hinge and the panel.

20. The work vehicle door of claim 16, wherein the hinge assembly comprises a bushing disposed between the first protrusion and the panel.

* * * * *